United States Patent [19]

Skaugen

[11] Patent Number: 4,854,053

[45] Date of Patent: Aug. 8, 1989

[54] TRANSFER APPARATUS

[75] Inventor: Borgeir Skaugen, Beloit, Wis.

[73] Assignee: Beloit Corporation, Beloit, Wis.

[21] Appl. No.: 44,390

[22] Filed: Apr. 30, 1987

[51] Int. Cl.[4] ..... D06F 58/00

[52] U.S. Cl. ..... 34/117; 34/121; 34/123

[58] Field of Search ..... 34/116, 117, 118, 119, 34/120, 121, 123

[56] References Cited

U.S. PATENT DOCUMENTS

| | | | |
|---|---|---|---|
| 3,009,343 | 11/1961 | Buehan | 34/118 |
| 4,030,320 | 6/1977 | Riedel | 34/118 X |
| 4,117,699 | 10/1978 | Renaut | 34/118 X |
| 4,485,567 | 12/1984 | Ely | 34/116 X |
| 4,566,949 | 1/1986 | Kopenen et al. | 34/116 X |
| 4,610,097 | 9/1986 | Kotitschke et al. | 34/120 X |
| 4,698,918 | 10/1987 | Kotitschke et al. | 34/116 |
| 4,698,919 | 10/1987 | Nedel | 34/117 |
| 4,710,271 | 12/1987 | Miller | 34/116 X |

*Primary Examiner*—Edgar S. Burr
*Assistant Examiner*—James R. McDaniel
*Attorney, Agent, or Firm*—Dirk J. Veneman; Raymond W. Campbell; David J. Archer

[57] ABSTRACT

A transfer apparatus is disclosed for transferring a web from a press section to a dryer section. The apparatus includes a plurality of rotatable rolls which are disposed between the press section and the dryer section. A transfer felt is movably supported by the plurality of rolls for transporting the web from the press section towards the dryer section. The plurality of rolls includes a rotatable guide roll which is disposed adjacent to the press section for guiding the web from the press section towards the dryer section. A rotatable turning roll cooperates with the dryer section such that the transfer felt disposed between the guide roll and the turning roll defines a transfer section. The transfer section supports the web along the entire length of the transfer section from the guide roll to the turning roll. A rotatable lead-in roll cooperates with the guide roll such that, in use of the apparatus, the web emerging from the press section is guided between the guide roll and the cooperating lead-in roll so that the web is guided and supported by the transfer felt, the web moving at the same speed and in the same direction as the transfer felt thereby inhibiting dusting of the pressed web.

10 Claims, 3 Drawing Sheets

TRANSFER APPARATUS

BACKGROUND OF THE INVENTION

Field of the Invention

This invention relates to a transfer apparatus for transferring a web from a press section to a dryer section. More specifically, this invention relates to a transfer apparatus in which a single transfer felt is used for transferring the web between the press and the dryer sections.

INFORMATION DISCLOSURE STATEMENT

In copending U.S. patent application, Ser. No. 888,021 assigned to Beloit Corporation, there is disclosed a transfer apparatus which includes a transfer section defined between two cooperating felts. The transfer section disclosed in the aforementioned pending application provides excellent support for the web so that the web is positively transferred from the press section to the dryer section without any possibility of sheet flutter or the like.

However, whenever two felts cooperate together for the transportation therebetween of a web, it is important that the direction and speed of movement of the felts be synchronized because if the respective felts do not travel at the same speed as each other, scuffing of the pressed web occurs. Such scuffing causes minute particles of the formed web to become detached from the main body of the web. This results in such dust particles adhering to the respective surfaces of the resultant web. Such "dusting" of the web during transfer from the pres section to the dryer section creates problems when the resultant web is used in various printing operations.

More specifically, the dust particles caused by the aforementioned "dusting" problem become lodged between the interstices of type face which results in serious printing problems.

The present invention seeks to overcome this dusting problem by utilizing a single felt for transferring the web from the press section to the drying section. Therefore, it is a primary object of the present invention to overcome the aforementioned inadequacies of the prior art web transfer apparatus and to provide an apparatus which offers a significant and non-obvious contribution to the papermaking art.

Another object of the present invention is the provision of a single-felted transfer apparatus for transferring a web from a press section to a drying section in which the transfer section is maintained in tension by means of an intermediate roll disposed between a guide roll and a turning roll.

Another object of the present invention is the provision of a single-felted transfer apparatus for transferring a web emerging from a press section to a drying section which includes a lead-in roll which cooperates with the guide roll, the lead-in roll being movable relative to the guide roll for permitting easy threading of the transfer apparatus.

Other objects and advantages of the present invention will be readily apparent to those skilled in the art by a consideration of the following detailed description of the preferred embodiment taken in conjunction with the annexed drawings.

SUMMARY OF THE INVENTION

The present invention relates to a transfer apparatus and method for transferring a web from a press section to a dryer section.

The transfer apparatus includes a plurality of rotatable rolls disposed between the press section and the dryer section. A transfer felt is movably supported by the plurality of rolls for transporting the web from the press section towards the dryer section. The plurality of rolls includes a rotatable guide roll which is disposed adjacent to the press section for guiding the web from the press section towards the dryer section. The plurality of rolls also includes a rotatable turning roll which cooperates with the dryer section such that the transfer felt which is disposed between the guide roll and the turning roll defines a transfer section. This transfer section supports the web along the entire length of the transfer section from the guide roll to the turning roll. A rotatable lead-in roll cooperates with the guide roll so that, in use of the apparatus, the web emerging from the press section is guided between the guide roll and the cooperating lead-in roll so that the web is guided and supported by the transfer felt with the web moving at the same speed and in the same direction as the transfer felt thereby inhibiting dusting of the pressed web.

In a more specific embodiment of the present invention, the plurality of rolls can include a rotatable intermediate roll which is disposed between the guide roll and the turning roll for maintaining tension in the transfer felt along the transfer section.

Additionally, the intermediate roll inhibits drooping of the transfer felt between the guide roll and the turning roll. Preferably the intermediate roll is a grooved roll and the guide roll has a fixed axis of rotation. The turning roll cooperates with a transfer roll of the dryer section such that the web moves together with the transfer felt between the turning roll and the transfer roll so that the web follows the transfer roll. The turning roll is pivotally-mounted to a frame such that the turning roll is permitted to be moved away from the transfer roll. The transfer section includes a first and a second portion, the first portion extending from the guide roll to the intermediate roll and the second portion extending from the intermediate roll to the turning roll.

The intermediate roll is urged in a direction from the transfer felt towards the web so that the first and second portions define therebetween an obtuse angle relative to each other.

The lead-in roll is adjustably secured to the frame so that the lead-in roll is permitted to move away from the guide roll during threading of the apparatus such that a tail of the web emerging from the press section is guided onto the transfer section between the lead-in roll and the guide roll. The lead-in roll is movable towards the guide roll so that the web is sandwiched between the lead-in roll and the transfer felt.

The present invention also includes a method of transferring a web from a press section to a dryer section. The method includes the steps of guiding the web emerging from the press section between a lead-in roll and a transfer felt movably supported by a guide roll. The web is supported by the transfer felt from the guide roll towards a turning roll where the web is transferred by a transfer roll into the dryer section. The web is supported by the transfer felt along a transfer section between the guide roll and the turning roll thereby avoiding any dusting of the web associated with double-felting transfer processes.

Although the preferred embodiment of the present invention and the operation thereof is fully disclosed herein, it will be evident to those skilled in the art that many variations and modifications of the present invention may be carried out without departing from the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION

Figure 1:
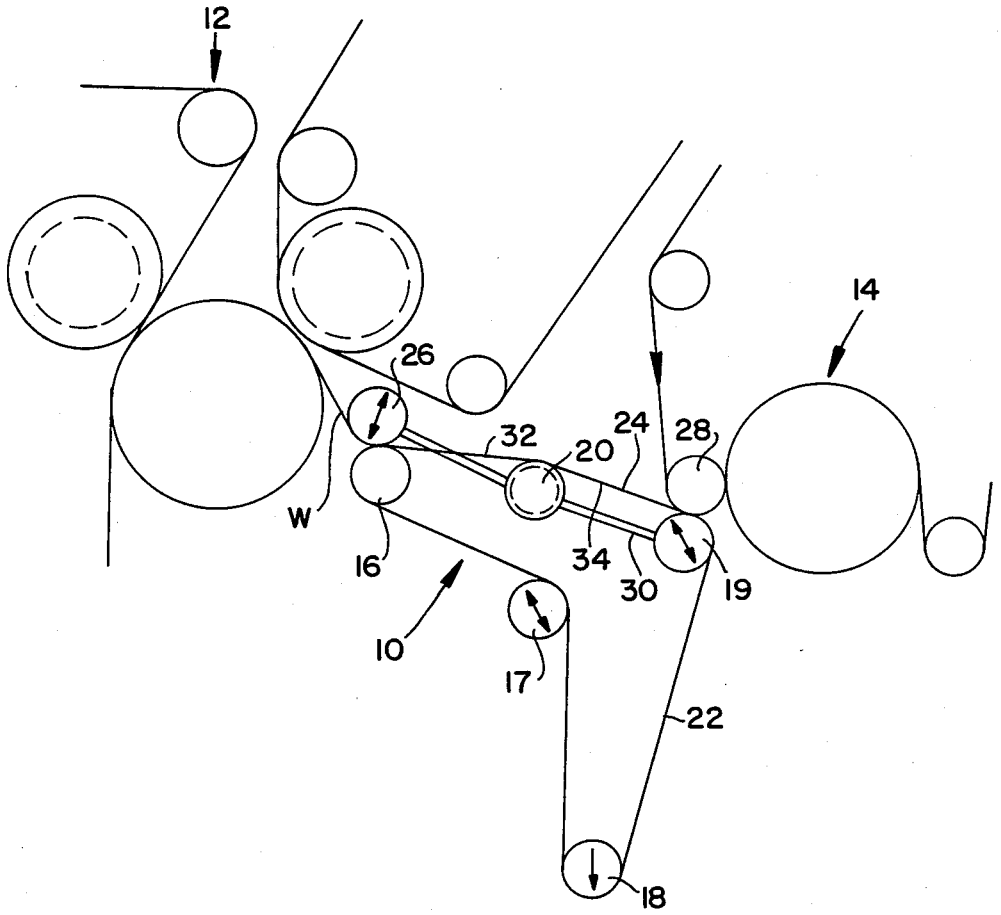
FIG. 1 is a side-elevational view of the transfer apparatus according to a first embodiment of the present invention.

FIG. 1 shows a transfer apparatus generally designated 10 for transferring a web W from a press section 12 to a dryer section 14. The apparatus 10 includes a plurality of rotatable rolls 16,17,18,19 and 20 which are disposed between the press section 12 and the dryer section 14. A transfer felt 22 is movably supported by the plurality of rolls 16–20 for supporting the web W from the press section 12 towards the dryer section 14. More specifically, the plurality of rolls 16 to 20 include a rotatable guide roll 16 which is disposed adjacent to the press section for guiding the web from the press section 12 towards the dryer section 14. The roll 19 is a rotatable turning roll which cooperates with the dryer section 14 such that the transfer felt 22 which is disposed between the guide roll 16 and the turning roll 19 defines a transfer section 24. The transfer section 24 supports the web W along the entire length of the transfer section 24 from the guide roll 16 to the turning roll 19. A rotatable lead-in roll 26 cooperates with the guide roll 16 such that in use of the apparatus the web W emerging from the press section 12 is guided between the guide roll 16 and the cooperating lead-in roll 26 so that the web W is guided and supported by the transfer felt 22. The web W moves at the same speed and in the same direction as the transfer felt 22 thereby inhibiting dusting of the pressed web W.

More specifically, the plurality of rolls 16 to 20 further includes a rotatable intermediate roll 20 which is disposed between the guide roll 16 and the turning roll 19 for maintaining tension in the transfer felt 22 along the transfer section 24. This intermediate roll 20 also inhibits drooping of the transfer felt 22 between the guide roll 16 and the turning roll 19. The intermediate roll 20 is preferably a grooved roll.

The guide roll 16 as shown in FIG. 1, has a fixed axis of rotation and the turning roll 19 cooperates with a transfer roll 28 of the drying section 14 such that the web W moves together with the transfer felt 22 between the turning roll 19 and the transfer roll 28 so that the web W follows the transfer roll 28. The turning roll 19 is pivotally-mounted to a frame 30 such that the turning roll 19 is permitted to be moved away from the transfer roll 28.

The transfer section 24 includes a first portion 32 which extends from the guide roll 16 to the intermediate roll 20. A second portion 34 of the transfer section 24 extends from the intermediate roll 20 to the turning roll 19. The intermediate roll 20 is urged in a direction from the transfer felt 22 towards the web W such that the first and second portions 32 and 34 respectively, define therebetween an obtuse angle relative to each other.

The lead-in roll 26 is adjustably secured, as shown in FIG. 1, to the frame 30 such that the lead-in roll 26 is permitted to move away from the guide roll 16 during threading of the apparatus 10 such that in use of the apparatus 10 a tail of the web W emerging from the press section 12 is guided onto the transfer section 24 between the lead-in roll 26 and the guide roll 16. The lead-in roll 26 is movable towards the guide roll 16 such that the web W is sandwiched between the lead-in roll 26 and the transfer felt 22.

Figure 2:
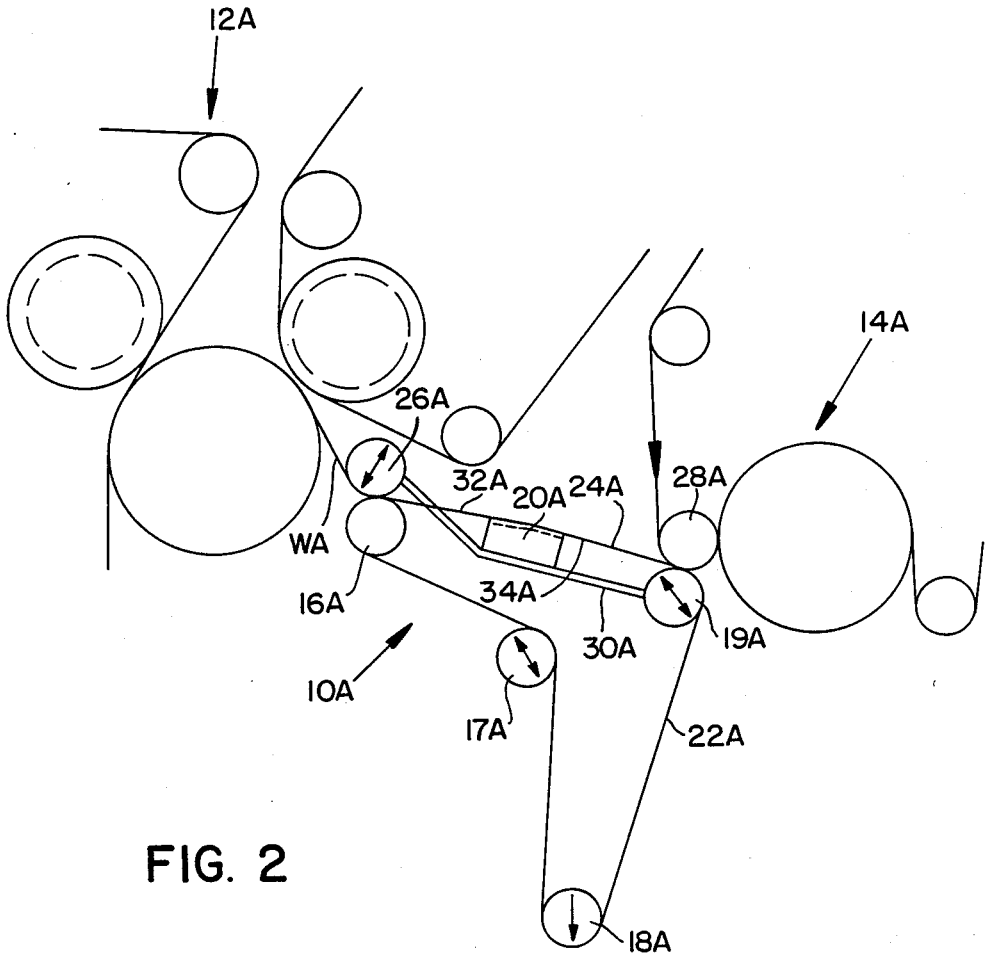
FIG. 2 is a side-elevational view of a transfer apparatus according to a second embodiment of the present invention.

FIG. 2 is a side-elevational view of a second embodiment of the present invention and is similar to the embodiment shown in FIG. 1 except that the intermediate roll 20, shown in FIG. 1, is replaced by a vacuum box 20A.

Figure 3:
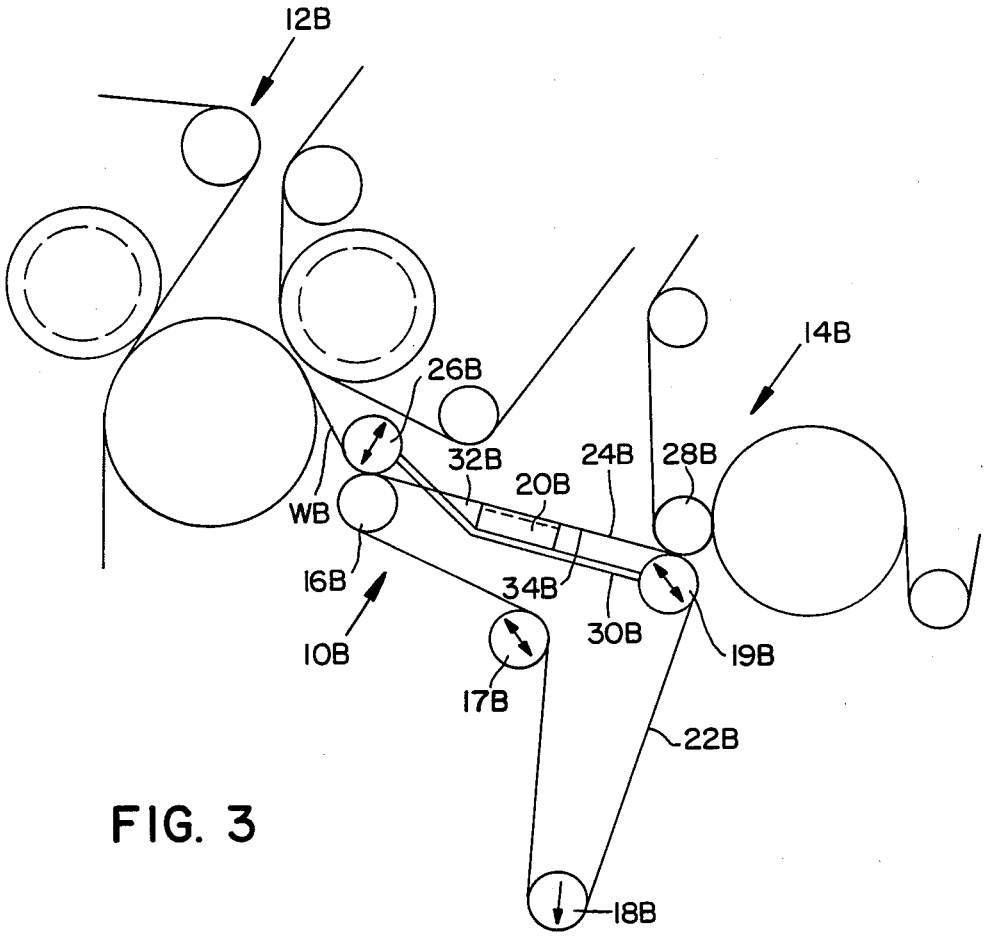
FIG. 3 is a side-elevational view of a transfer apparatus according to to a third embodiment of the present invention.

FIG. 3 is a side-elevational view of a third embodiment of the present invention and is similar to the embodiment shown in FIG. 1, however, the transfer section 24B is a flat run between the guide roll 16B and the turning roll 19B. A flat vacuum box 20B is disposed beneath the transfer section 24B.

In each of the embodiments shown in FIGS. 1–3 respectively, the rolls 16,16A,16B and 28,28A,28B may be vacuum type pocket ventilation rolls.

In operation of the transfer apparatus 10 as shown in FIG. 1, the lead-in roll 26 is moved away from the guide roll 16 and the press section 12 is rotated such that a tail of the web W may be guided through the gap defined between the lead-in roll 26 and the guide roll 16. The tail of the web W is supported by the transfer felt 22 along the transfer section 24 towards the intermediate roll 20. The lead-in roll 26 is lowered towards the guide roll 16 so that when the transfer felt 22 is driven, the web W will be drawn between the lead-in roll 26 and cooperating guide roll 16 such that the web W is supported by, and guided towards, the turning roll 19. During initial threading, the turning roll 19 is pivoted away from the transfer roll 28 thereby permitting the tail of the web W to be threaded between the transfer roll 28 and the cooperating dryer drum of the dryer section 14. When the tail of the web W has been threaded into the dryer section, the turning roll 19 is moved upwardly into engagement with the transfer roll 28 s that the web W is supported by, and guided between, the guide roll 16 and the turning roll 19.

The intermediate roll 20 adjustably presses against the underside of the transfer felt 22 between the guide roll 16 and the turning roll 19 so that adequate tension is maintained along the transfer section 24.

In the embodiment shown in FIG. 2, the grooved intermediate roll 20 is replaced by a vacuum box 20A having a porous upper surface of convex configuration positioned such that the transfer section 24A is divided into a first and a second portion 32A and 34A thereby maintaining adequate tension in the transfer section 24A.

The operation of the apparatus shown in FIG. 3 is similar to that of the operation of the apparatus shown in FIG. 1, however, the intermediate roll 20 is replaced by a flat top vacuum box 20B which is disposed immediately below the transfer section 24B so that the transfer section 24B maintains a flat configuration between the guide roll 16B and the turning roll 19B.

The present invention provides a simple and relatively inexpensive apparatus for transferring a web from a press section to a dryer section while avoiding the problem of dusting associated with double-felted transfer apparatus. Additionally, the apparatus of the present invention enables easy threading of the web between the press section and the dryer section.

What is claimed is:

1. A transfer apparatus for transferring a web from a press section to a dryer section, said apparatus comprising:

a plurality of rotatable rolls disposed between the press section and the dryer section;

a transfer felt movably supported by said plurality of rolls for transporting the web from the press section towards the dryer section;

said plurality of rolls including:

a rotatable guide roll disposed adjacent to the press section for guiding the web from the press section towards the dryer section;

a rotatable turning roll cooperating with the dryer section such that said transfer felt disposed between said guide roll and said turning roll defines a transfer section;

said transfer section supporting the web along the entire length of said transfer section from said guide roll to said turning roll, said felt and the web separating relative to each other during passage around said turning roll and departing from said turning roll in different directions; and a rotatable lead-in roll forming a nip with said guide roll and physically contacting the web and bringing the web into initial contact with said transfer felt as said web and said transfer felt pass said guide roll such that in use of the apparatus, the web emerging from the press section is guided between said guide roll and said cooperating lead-in roll so that the web is guided and supported by said transfer felt, the web moving at the same speed and in the same direction as said transfer felt, thereby inhibiting dusting of the pressed web.

2. A transfer apparatus as set forth in claim 1 wherein said plurality of rolls further includes:

a rotatable intermediate roll disposed between said guide roll and said turning roll for maintaining tension in said transfer felt along said transfer section and inhibiting drooping of said transfer felt between said guide roll and said turning roll.

3. A transfer apparatus as set forth in claim 2 wherein said intermediate roll is a grooved roll.

4. A transfer apparatus as set forth in claim 1 wherein said guide roll has a fixed axis of rotation.

5. A transfer apparatus as set forth in claim 1 wherein said turning roll cooperates with a transfer roll of the drying section such that the web moves together with said transfer felt between said turning roll and said transfer roll so that the web follows said transfer roll.

6. A transfer apparatus as set forth in claim 5 wherein said turning roll is pivotally-mounted to a frame such that said turning roll is permitted to be moved away from said transfer roll.

7. A transfer apparatus as set forth in claim 2 wherein said transfer section includes:

a first portion extending from said guide roll to said intermediate roll;

a second portion extending from said intermediate roll to said turning roll;

said intermediate roll being urged in a direction from said transfer felt towards the web such that said first and second portions define therebetween an obtuse angle relative to each other.

8. A transfer apparatus as set forth in claim 1 wherein said lead-in roll is adjustably secured to a frame such that said lead-in roll is permitted to move away from said guide roll during threading of the apparatus such that in use of the apparatus, a tail of the web emerging from the press section is guided onto said transfer section between said lead-in roll and said guide roll, said lead-in roll being movable toward said guide roll such that the web is sandwiched between said lead-in roll and said transfer felt.

9. A transfer apparatus for transferring a web from a press section to a dryer section, said apparatus comprising:

a plurality of rotatable rolls disposed between the press section and the dryer section;

a transfer felt movably supported by said plurality of rolls for transporting the web from the press section towards the dryer section;

said plurality of rolls including:

a rotatable guide roll disposed adjacent to the press section for guiding the web from the press section towards the dryer section;

a rotatable turning roll cooperating with the dryer section such that said transfer felt disposed between said guide roll and said turning roll defines a transfer section;

said transfer section supporting the web along the entire length of said transfer section from said guide roll to said turning roll, said felt and the web separating relative to each other during passage around said turning roll and departing from said turning roll in different directions; and an adjustable rotatable lead-in roll forming a nip with said guide roll and physically contacting the web and bringing the web into initial contact with said transfer felt as said web and said transfer felt pass said guide roll, said lead-in roll being movable towards, and away from, said guide roll such that in use of the apparatus, the web emerging from the press section is guided between said guide roll and said cooperating lead-in roll so that the web is guided and support by said transfer felt, the web moving at the same speed and in the same direction as said transfer felt, thereby inhibiting dusting of the pressed web.

10. A method of transferring a web from a press section to a dryer section, the method including the steps of:

guiding the web between a lead-in roll and a cooperating transfer felt movably supported by a guide such that a nip is formed with said guide roll and said lead-in roll and the web is initially brought into contact with said transfer felt as said web and said transfer felt pass said guide roll;

supporting the web on the transfer felt between the guide roll and a turning roll disposed adjacent to the dryer section such that the web is supported by the transfer felt along a transfer section between the guide roll and the turning roll thereby preventing dusting of the web associated with a double-felting transfer; and separating the web from the transfer felt during passage of the web and transfer felt around the turning roll such that the web and the transfer felt depart from said turning roll in different directions.

* * * * *